US006298753B1

(12) United States Patent
Izumisawa

(10) Patent No.: US 6,298,753 B1
(45) Date of Patent: Oct. 9, 2001

(54) RATCHET WRENCH

(75) Inventor: Nobuyuki Izumisawa, Tokyo (JP)

(73) Assignee: Kabushiki Kaisha Shinano Seisakusho, Tokyo (JP)

( * ) Notice: Subject to any disclaimer, the term of this patent is extended or adjusted under 35 U.S.C. 154(b) by 0 days.

(21) Appl. No.: 09/670,502

(22) Filed: Sep. 26, 2000

(30) Foreign Application Priority Data

Aug. 10, 2000 (JP) ..... 8-242666

(51) Int. Cl.[7] ..... B25B 13/46
(52) U.S. Cl. ..... 81/57.39
(58) Field of Search ..... 81/57.39, 62–632

(56) References Cited

U.S. PATENT DOCUMENTS 5,142,952 * 9/1992 Putney et al. ..... 81/57.39
5,155,952 * 10/1992 Hansson ..... 81/467
5,158,421 * 10/1992 Simonin ..... 81/464

* cited by examiner

*Primary Examiner*—D. S. Meislin
(74) *Attorney, Agent, or Firm*—Jordan and Hamburg LLP

(57) ABSTRACT

In a ratchet wrench, power generated by an air motor is transmitted to a ratchet mechanism via a reduction gear mechanism, so that a rotary tightening member connected to the ratchet mechanism is operated. A flywheel is fitted onto a shaft of the air motor in order to increase the tightening torque.

2 Claims, 2 Drawing Sheets

RATCHET WRENCH

BACKGROUND OF THE INVENTION

1. Field of the Invention

The present invention relates to a ratchet wrench.

2. Background of the Invention

According to a conventional ratchet wrench, power generated by an air motor (i.e., a motor driven by compressed air) is transmitted to a ratchet mechanism via a reduction gear mechanism, to thereby rotate a tightening member connected to the ratchet mechanism.

When the tightening torque of such a conventional ratchet wrench is to be increased, the following two methods have been employed:

a) increasing the longitudinal size of the air motor; and b) increasing the outer diameter of the rotor of the air motor.

However, method a) has a drawback in that, even when the motor output is increased by increasing the longitudinal size of the air motor, the tightening torque does not necessarily increase. Method b) has a drawback in that there is a limit to how much the outer diameter of the rotor can be increased; that is, since the motor housing serves as a grip of the ratchet wrench and the grip cannot be made extremely large in diameter, the outer diameter of the rotor of the air motor cannot be enlarged very much.

SUMMARY OF THE INVENTION

In consideration of the above-described problem of the conventional art, an object of the present invention is to provide a ratchet wrench whose tightening torque can be increased without any change in size of the air motor.

The present invention provides a ratchet wrench comprising an air motor; a ratchet mechanism which receives power generated by the air motor via a reduction gear mechanism; a rotary tightening member connected to the ratchet mechanism so as to be rotated by the ratchet mechanism; and a flywheel fitted onto a shaft of the air motor.

Preferably, a tip end of the shaft of the air motor is in engagement with the reduction gear mechanism, and the flywheel is disposed between the rotor of the air motor and the reduction gear mechanism.

DESCRIPTION OF THE PREFERRED EMBODIMENT

Figure 1:
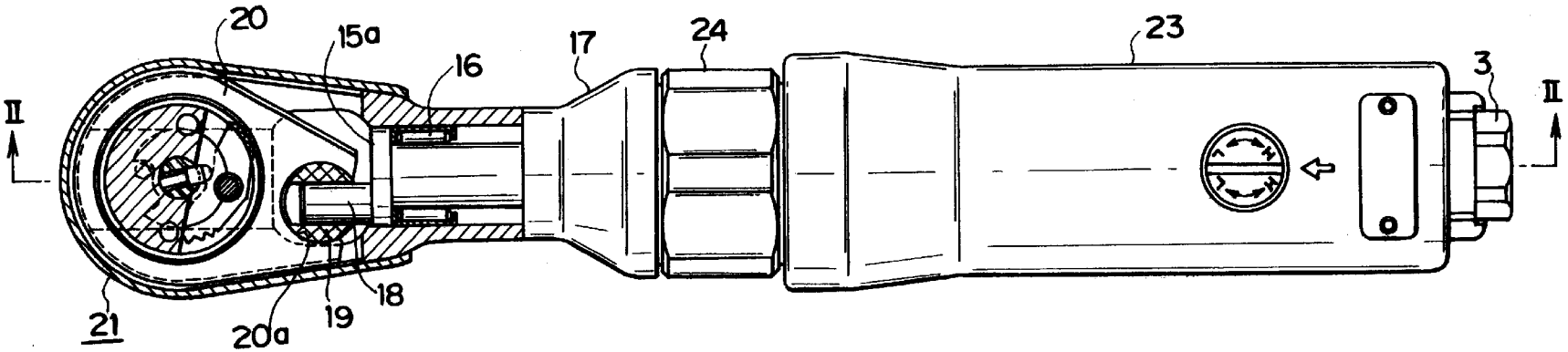
FIG. 1 is a front view of the ratchet wrench according to an embodiment of the present invention.

An embodiment of the present invention will be described with reference to the drawings.

In the drawings, reference numeral 1 denotes an air motor accommodated in a motor housing 5. Upon operation of an open-close lever 2, pressurized air is fed from an air induction port 3 to the air motor 1 via an open-close valve 4, so that a rotor 6 and a shaft 9 of the air motor 1 rotate. The motor housing 5 is covered with a body cover 23, which serves as a grip of the ratchet wrench. The body cover 23 is preferably formed of resin.

In the air motor 1, the rotor 6 is rotatably supported by bearings 7 and 8 fixed to the motor housing 5. The shaft 9 is rotatably supported by the bearing 8. The tip end of the shaft 9 is in engagement with a reduction gear mechanism 10. A flywheel 11 is fitted onto the shaft 9. Preferably, the flywheel 11 has an annular shape and is fitted onto the shaft 9 by press fitting.

The flywheel 11 is disposed between the rotor 6 and the reduction gear mechanism 10. The reduction gear mechanism 10 includes three idle gears 12, an internal gear 13, and a cage 14. The idle gears 12 are in meshing-engagement with the shaft 9. The internal gear 13 is in meshing-engagement with the idle gears 12 and is fixed into a driver housing 17, which is coupled with the motor housing 5 by way of a lock ring 24. The cage 14 is coupled to each of the idle gears 12 via a respective idle pin 25 and is in engagement with a crankshaft 15.

Figure 2:
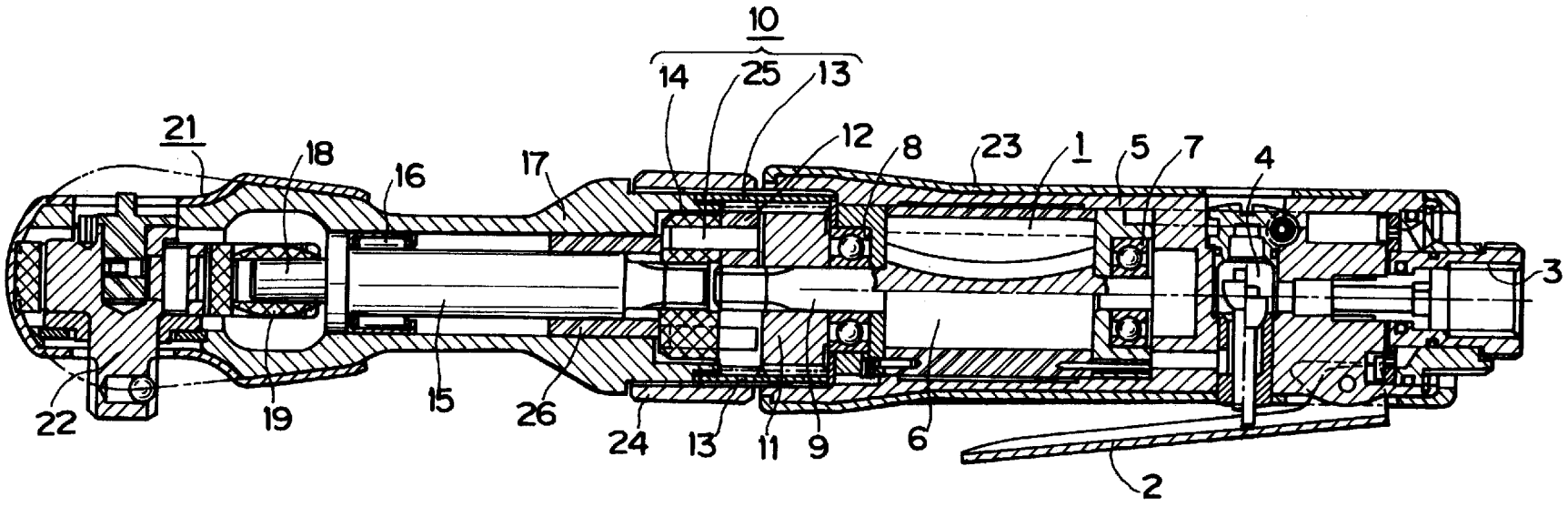
FIG. 2 is a cross section of the ratchet wrench taken along line II—II in FIG. 1.

In the embodiment in FIG. 2, the three idle gears 12 are disposed around the shaft 9. Each of the idle gears 12 is rotatably fixed onto the corresponding idle pin 25. The cage 14 is fixed to the idle pins 25 (three idle pins in the embodiment of FIG. 2), so that, when the idle gears 12 revolve around the shaft 9, the cage 14 rotates about its axis, and the crankshaft 15 rotates.

In the driver housing 17, the crankshaft 15 is rotatably supported by a bush 26 on the side of the reduction gear mechanism 10 and a needle bearing 16 on the side of a ratchet mechanism 21 (described later).

The crankshaft 15 has a crank pin 18 projecting from a tip end surface 15*a* at an eccentric position. The crank pin 18 is rotatably connected to a bush 19, which is rotatably fitted in a recess 20*a* of a yoke 20. The yoke 20 is connected to a rotary tightening member 22 via the ratchet mechanism 21.

When an object, such as a bolt or nut, is tightened by use of the ratchet wrench having the above-described structure, the rotary tightening member 22 is engaged with the object, and the open-close lever 2 is operated. As a result, the air motor I operates, and the shaft 9 rotates together with the rotor 6. At this time, the flywheel 11 fitted onto the shaft 9 rotates integrally with the shaft 9. The flywheel 11 has a large moment of inertia. By use of the inertia, the tightening torque of the ratchet wrench is averaged.

The rotation speed of the shaft 9 is reduced through the reduction gear mechanism 10. Rotational motion of the shaft 9 is transmitted to the crankshaft 15 and is converted to swing motion by the action of the crank pin 18. The swing motion is then transmitted to the yoke 20, so that the yoke 20 swings repeatedly. The swinging motion of the yoke 20 is converted to rotary motion of the rotary tightening member 22, whereby the bolt or nut is tightened.

As described above, the present invention provides the ratchet wrench, in which power generated by the air motor is transmitted to the ratchet mechanism via the reduction gear mechanism to thereby operate the rotary tightening member connected to the ratchet mechanism, and the flywheel is fitted onto the shaft of the air motor. The effect of the flywheel fitted onto the shaft is confirmed by the test results shown in TABLE 1. When the motor is 30 mm in diameter and 38.1 mm in length, and has a maximum output of 250 W and an air consumption of 0.4 $m^3$/min, tightening torque increases by about 19% through provision of the flywheel. When the motor is 30 mm in diameter and 45 mm in length, and has a maximum output of 300 W and an air consumption of 0.73 $m^3$/min, tightening torque increases by about 28% through provision of the flywheel.

TABLE 1

Comparative table of torque of ratchet wrenches

| | Product No. | Flywheel | Motor size diameter (mm) × length (mm) | Maximum motor output (W) | Air consumption $m^3$/min | Maximum torque (Nm)* | Normalized torque achieved through provision of the flywheel |
|---|---|---|---|---|---|---|---|
| 1 | A | Not provided | ϕ30 × 38.1 | 250 | 0.4 | 91 | — |
| 2 | AA | Provided | ϕ30 × 38.1 | 250 | 0.4 | 108 | 1.19 |
| 3 | B | Not provided | ϕ30 × 45.0 | 300 | 0.73 | 98 | — |
| 4 | BB | Provided | ϕ30 × 45.0 | 300 | 0.73 | 125 | 1.28 |

*measured by a screw-tightening-type hydraulic torque meter.

Furthermore, the reduction gear mechanism is in engagement with the tip end of the shaft of the air motor, and the flywheel is disposed between the rotor of the air motor and the reduction gear mechanism. Therefore, the tightening torque of the ratchet wrench can be increased through a slight increase in the longitudinal size of the air motor, while the diameter of the motor housing serving as the grip is maintained unchanged.

What is claimed is:

1. A ratchet wrench comprising:

an air motor;

a ratchet mechanism which receives power generated by the air motor via a reduction gear mechanism;

a rotary tightening member connected to the ratchet mechanism so as to be rotated by the ratchet mechanism; and a flywheel fitted onto a shaft of the air motor.

2. A ratchet wrench according to claim 1, wherein a tip end of the shaft of the air motor is in engagement with the reduction gear mechanism; and the flywheel is disposed between a rotor of the air motor and the reduction gear mechanism.

* * * * *